US006428359B2

(12) United States Patent
Van Zanten

(10) Patent No.: US 6,428,359 B2
(45) Date of Patent: Aug. 6, 2002

(54) CABLE CONNECTOR COMPRISING A HOUSING, A SHIELDING AND AT LEAST ONE CONNECTOR MODULE IN THE HOUSING

(75) Inventor: Albertus Van Zanten, Hertogenbosch (NL)

(73) Assignee: Framatome Connectors International, Courbevoie (FR)

( * ) Notice: Subject to any disclaimer, the term of this patent is extended or adjusted under 35 U.S.C. 154(b) by 0 days.

(21) Appl. No.: 09/843,602

(22) Filed: Apr. 26, 2001

(30) Foreign Application Priority Data

Apr. 28, 2000 (NL) ..... 1015059

(51) Int. Cl.[7] ..... H01R 9/03

(52) U.S. Cl. ..... 439/610; 439/108; 439/608; 439/906; 439/696

(58) Field of Search ..... 439/610, 607, 439/687, 608, 696, 101, 108, 906

(56) References Cited

U.S. PATENT DOCUMENTS 5,176,538 A 1/1993 Hansell, III et al. ..... 439/607
5,421,746 A 6/1995 David ..... 439/701
5,563,450 A * 10/1996 Bader et al. ..... 257/785
5,835,071 A * 11/1998 Phelps ..... 343/906
5,885,100 A * 3/1999 Talend et al. ..... 439/490
6,058,024 A * 5/2000 Lyford ..... 361/816
6,232,684 B1 * 5/2001 Haag et al. ..... 310/68 R
6,296,514 B1 * 10/2001 Medina et al. ..... 439/404

FOREIGN PATENT DOCUMENTS

EP 0421373 A1 4/1991
EP 0736931 A1 10/1996
EP 0964479 A1 12/1999
EP 0971451 A2 1/2000

* cited by examiner

*Primary Examiner*—Tho D. Ta
*Assistant Examiner*—Truc Nguyen
(74) *Attorney, Agent, or Firm*—Perman & Green, LLP

(57) ABSTRACT

A cable connector comprising a housing, which forms a shielding and/or which is provided with a shielding, and at least one connector module placed within the housing, which module comprises a body of an electrically insulating material, a circuit substrate comprising a grounding layer and one or more terminals mounted on the circuit substrate. The shielding of the housing is electrically connected to the grounding layer of the circuit substrate, thus improving the grounding of the entire cable connector.

8 Claims, 3 Drawing Sheets

CABLE CONNECTOR COMPRISING A HOUSING, A SHIELDING AND AT LEAST ONE CONNECTOR MODULE IN THE HOUSING

BACKGROUND OF THE INVENTION

1. Field of the Invention

The invention pertains to a cable connector comprising a housing, which forms a shielding and/or which is provided with a shielding, and at least one connector module placed within the housing, which module comprises a body of an electrically insulating material, a circuit substrate comprising a grounding layer and one or more terminals mounted on the circuit substrate.

2. Description of Prior Developments

Such cable connectors are known, for example from EP 0 736 931, and are used, for instance, to provide a cable-to-panel electrical connection between a cable and a printed circuit board (PCB) of, for instance, a telephone exchange device or the like. Cable connectors of this kind allow operation at high speed.

In modern applications, a permanent need exists for increased speed (e.g., gigabits and beyond) and enhanced signal integrity and it is therefore desirable to further improve, amongst other things, the grounding of cable connectors.

SUMMARY OF THE INVENTION

To this end, the connector of the present invention is characterized in that the shielding of the housing is electrically connected to the grounding layer of the circuit substrate and in that the housing contains a resilient clip of an electrically conducting material, which clip establishes electrical contact between the grounding layer of the circuit substrate and the shielding of the housing or, upon connection of the cable connector to a counterpart, a grounding layer comprised in that counterpart.

Thus, it appeared that the overall grounding of the cable connector can be improved considerably and the detrimental effects of, for instance, phase differences in differential pairs (which are frequently used in this kind of cable connector) are suppressed more effectively.

In a very robust and cost effective embodiment of the present invention, the housing comprises an inwardly protruding projection that contacts the grounding layer of the circuit substrate and that establishes electrical contact between the shielding of the housing and the grounding layer. Accordingly, it is preferred that the body of the connector module comprises a slit or opening for accommodating the protruding projection.

In a further embodiment of the present invention, the housing contains a resilient clip of an electrically conducting material, which clip establishes electrical contact between the grounding layer of the circuit substrate on the one hand and the shielding of the housing or, upon connection of the cable connector to a counterpart, a grounding (layer) comprised in that counterpart on the other hand. Thus, the grounding of a connector and/or a connection established using the connector of the present invention is substantially improved.

The invention also pertains to a kit for assembling the above-described cable connector, wherein the housing comprises an inwardly protruding projection and/or the kit contains a resilient clip and wherein the projection and/or the clip, upon assembly of the connector, serve to establish electrical contact between the shielding and the grounding layer.

BRIEF DESCRIPTION OF THE DRAWINGS

The invention will be further explained with reference to the drawings, in which two embodiments of the connector according to the present invention are schematically shown.

DESCRIPTION OF THE PREFERRED EMBODIMENTS

Figure 1:
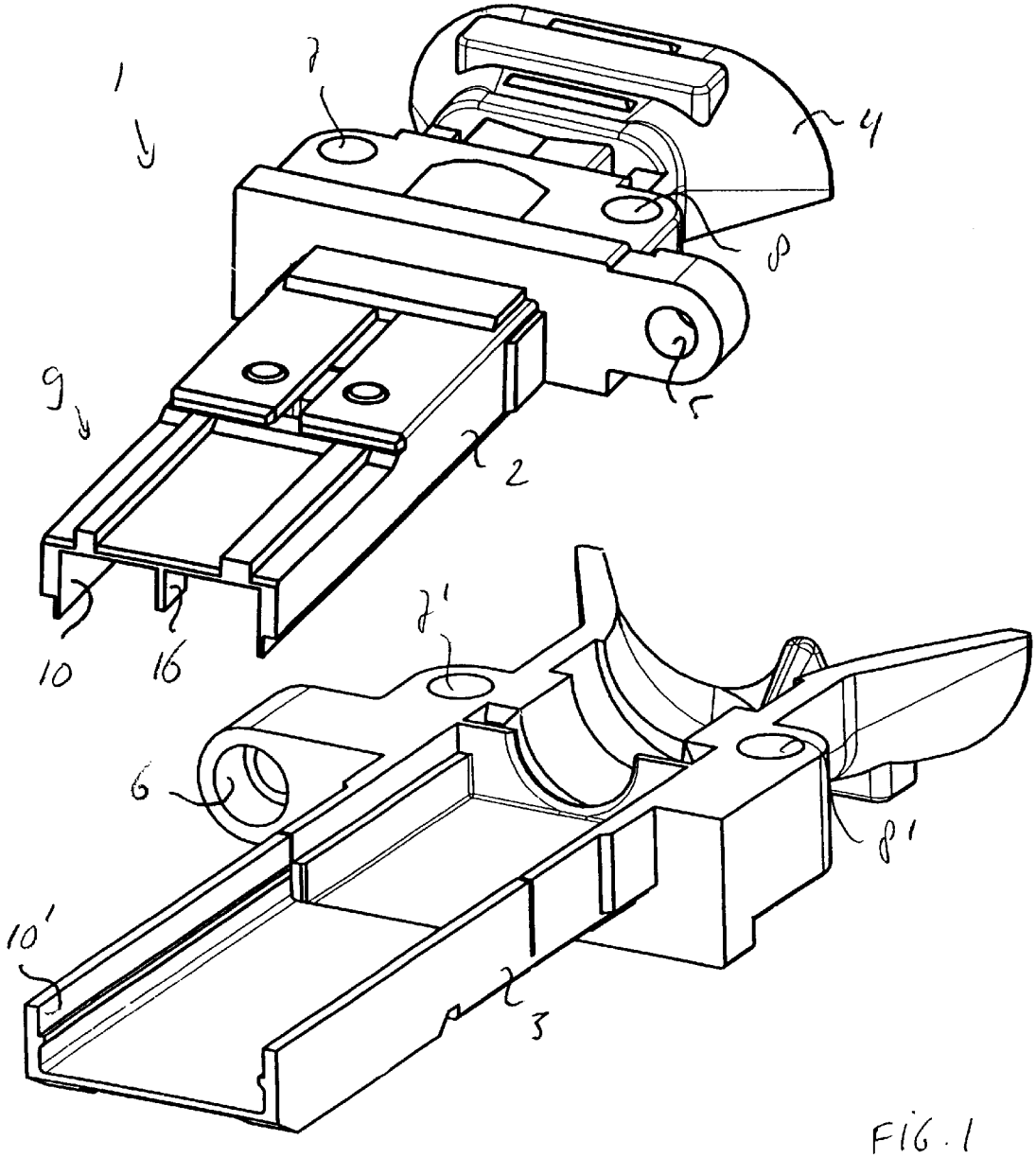
FIG. 1 is an exploded view of a housing of a first embodiment of a cable connector in accordance with the present invention.

FIG. 1 shows a housing 1 of a cable connector according to the present invention, which housing 1 consists of an upper part 2 and a lower part 3. The housing 1 may be manufactured of a metal, such as aluminium, and thus inherently function as a shielding against electromagnetic interference (EMI). Alternatively, the housing may be manufactured of an electrically insulating material, e.g., a plastic material, such as a nylon or a liquid crystalline polymer. In that case, the housing should be provided with EMI shielding on its outer surface. Such an EMI shielding may, for instance, consist of an electrically conducting metal coating. Such coatings are known to the persons skilled in the art and may, for instance, comprise a copper layer with a thickness of say 1–2 $\mu$m on which a nickel or aluminium layer of say 2–3 $\mu$m has been deposited. The shielding of the housing 1 should, upon attachment of the connector to a cable, preferably be electrically connected to the shielding of the cable, such as a braid.

The rear end of the connector 1 comprises a conical sleeve 4 for receiving a cable. Both the upper part 2 and the lower part 3 of the housing 1 are provided with a hole 5 resp. 6 for receiving a means, such as a screw or the like, for attaching the connector to a counterpart. Through-holes 7, 7', 8, 8' are provided for securing the two parts 2, 3 together.

Figure 2:
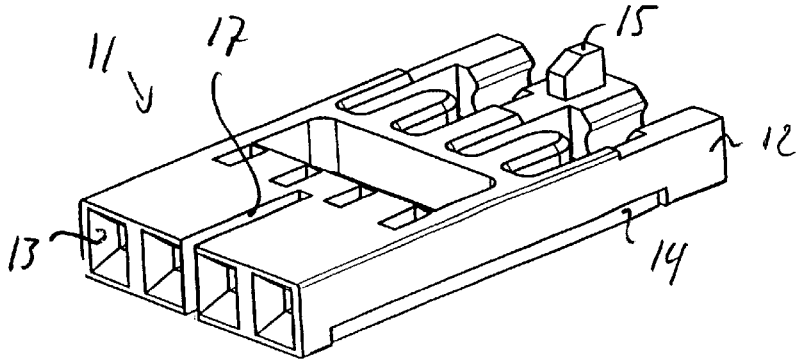
FIG. 2 is an isometric view of connector module intended for use in combination with the housing according to FIG. 1.

The front end 9 of the housing 1 comprises a cavity 10, 10' for receiving two stacked connector modules 11, one of which is shown in FIG. 2. The cable connector module 11 comprises a body 12 of an electrically insulating material. The body 12 is preferably formed by moulding a polymeric resin having appropriate strength and heat resistance characteristics, such as nylon 66 or a liquid crystalline polymer. The front edge of the body 12 defines a mating interface for receiving terminals of a counterpart through a plurality of openings 13. For example, the connector module 11 could match with one column of an array of terminal pins arranged in rows and columns in a pin header backplane connector, with such pins generally being inserted into the openings in a direction parallel to the longitudinal axis of the connector module 11.

A circuit substrate 14, i.e. preferably a generally planar printed circuit board (PCB), is received on one of the major sides of the body 12. The circuit substrate 14 is retained and located with respect to the body 12 by a securing)locating post (not shown) extending from the body 12 and receivable in an opening (also not shown) in the circuit substrate 14.

The circuit substrate 14 may be of multi-layer construction and incorporates a grounding layer or ground plane, which can be either located on the surface that abuts the body 12 or on the surface that faces away from the body 12. The connector module 11 further comprises four receptacle terminals located behind the openings 13 in the mating surface. This particular example shows an 1×4 connector module, two of which are to be used in the housing 1 of FIG. 1. However, other modules, for instance, a 2×4 module, or a 2×6 module or two 2×6 modules may be employed. As a matter of course, the shape and size of the cavity 10, 10' should be adapted to receive a selected (stack of) connector module(s)

Figure 5:
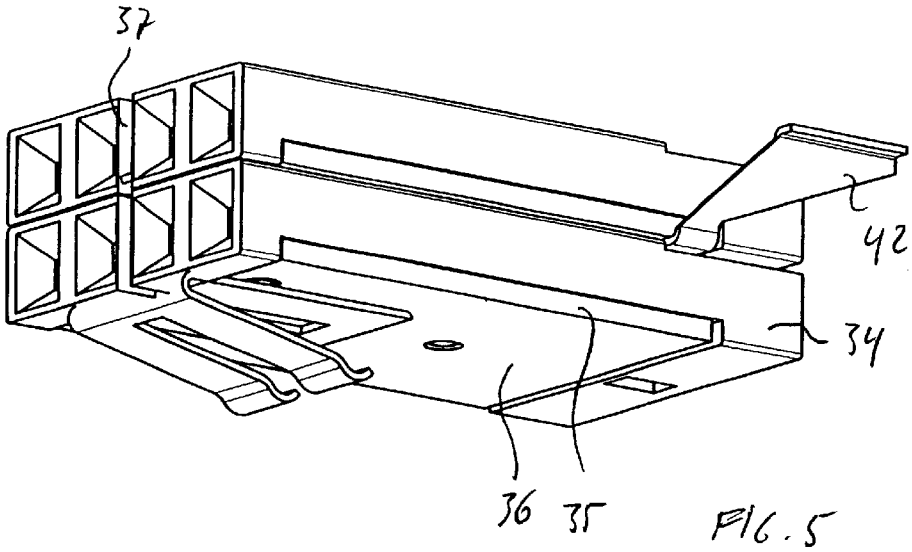

The body 12 is further equipped with a projection 15 on its upper surface which serves to position the connector module 11 with respect to the housing 1 of the connector or with respect to a further cable connector module placed on top of this connector module (as shown in FIG. 5).

The upper part 2 of the housing 1 of the connector comprises an inwardly protruding projection 16 near its mating end, whereas the cable connector module 11 is equipped with a slit 17 for receiving the protruding projection 16. The projection 16 is sufficiently long to abut the ground plane of the circuit substrate 14 or, if the ground plane is located on the surface that faces away from the body 12 and the projection 16, to abut a plated through-hole or an electrical lead through the circuit substrate 14. Thus, the projection 16 establishes electrical contact between the shielding of the housing 1 and the said grounding layer.

Figure 3:
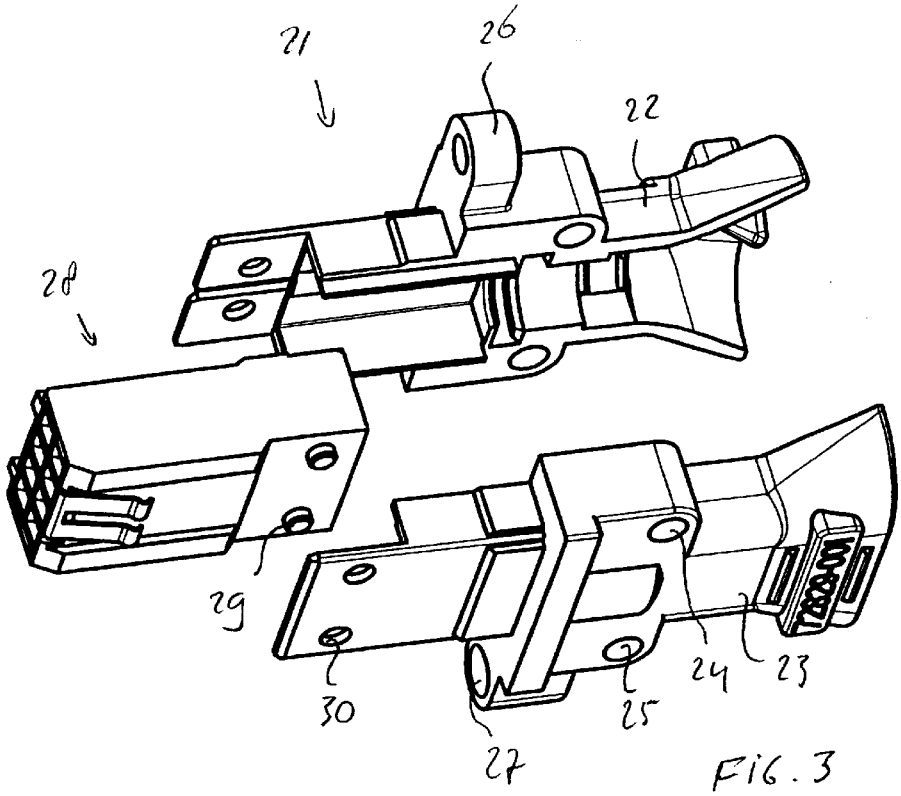
FIG. 3 is an exploded view of a second embodiment of a cable connector in accordance with the present invention.

FIG. 3 shows a (disassembled) second embodiment of the cable connector according to the present invention. This connector 21 again comprises a housing having an upper part 22 and a lower part 23. The said parts 22, 23 each comprise two through-holes 24, 24', 25, 25' for securing the two parts 22, 23 together and through-holes 26, 27 for attaching the connector 21 to a counterpart. A cable connector module 28 can be positioned between the parts 22, 23. To this end, the cable connector module 28 comprises four securing/locating posts 29 which are receivable in openings 30 in the upper and lower parts 22, 23.

Figure 4:
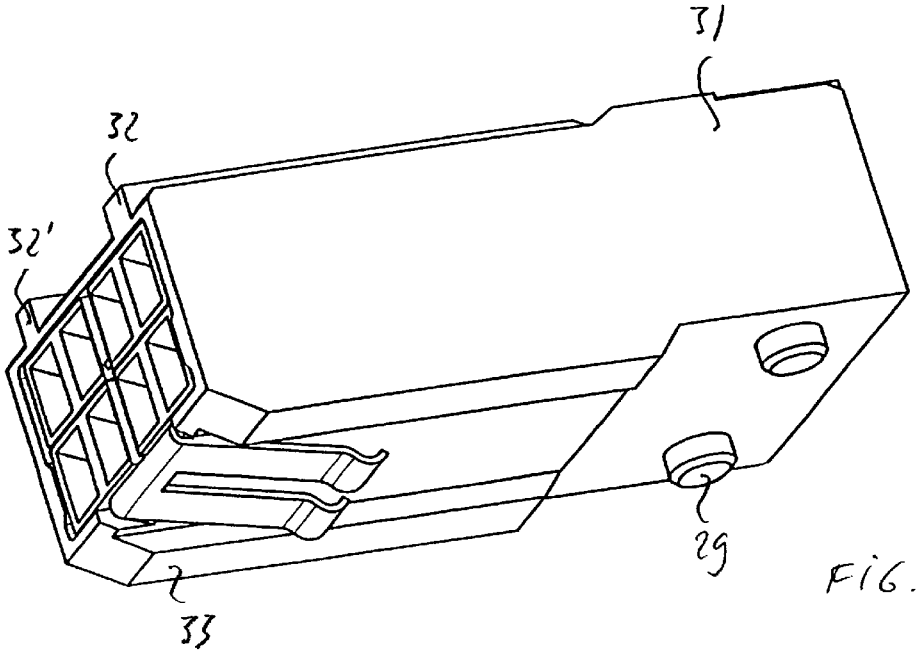
FIGS. 4 and 5 show two connector modules for use in the cable connector of FIG. 3, respectively with and without an additional outer housing.

As shown in more detail in FIG. 4, the cable connector module 28 comprises an outer housing 31 of an electrically insulating material such as the aforementioned plastic materials. The outer housing 31 comprises alignment rails 32, 32' for aligning the connector 21 with respect to a counterpart. The outer housing 31 contains two 1×4 connector modules 34 similar to the one shown in FIG. 2.

FIG. 5 shows the connector module 28 without the outer housing 31. Each of the 1×4 modules 34 comprises a circuit substrate 35, each of which comprises a grounding layer 36 covering its lower surface.

Figure 6:
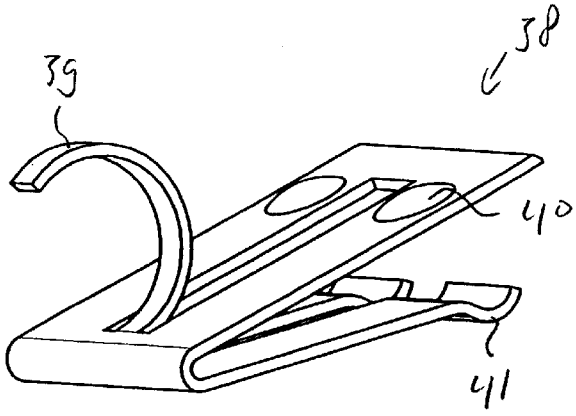
FIGS. 6 and 7 each show a clip for use in the cable connector of FIG. 3.

A clip 38, as shown in FIG. 6, has been mounted against the lower surface, i.e. the grounding layer 36, of the lower of the two connector modules 34. The clip 38 comprises a semicircular element 39, which abuts the grounding layer of the upper of the two connector modules. It further comprises two protrusions 40, which abut the grounding layer 36, as well as two resilient arms 41 for contacting, upon connection of the connector 21 to a counterpart, a grounding layer in the said counterpart.

Figure 7:
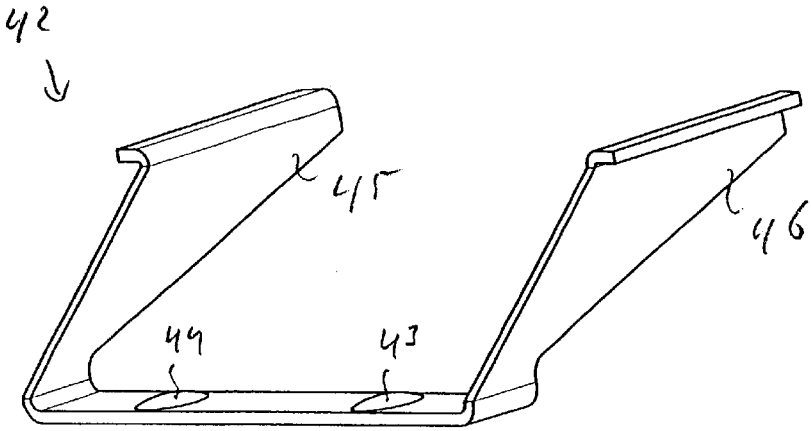

To further enhance the grounding of the connector 21, a connecting element 42, as shown in detail in FIG. 7, is provided which is manufactured of an electrically conducting material. Upon assembly of the connector 21, the connecting element 42 abuts the grounding layer of the upper connector module by means of two protrusions 43, 44 and is electrically connected to the upper part 22 of the housing of the connector 21 by means of extensions 45, 46.

It will be clear from the above embodiments that the connectors according to the invention exhibit improved grounding, which has been extended to components contained in the connector as well as to a counterpart of the connector.

The invention is not restricted to the above-described embodiments, which can be varied in a number of ways within the scope of the claims.

What is claimed is:

1. A cable connector comprising a housing, which forms a shielding and/or which is provided with a shielding, and at least one connector module placed within the housing, which module comprises a body of an electrically insulating material, a circuit substrate comprising a grounding layer and one or more terminals mounted on the circuit substrate, wherein the shielding of the housing is electrically connected to the grounding layer of the circuit substrate and wherein the housing contains a resilient clip of a electrically conducting material, which clip establishes electrical contact between the grounding layer of the circuit substrate and, upon connection of the cable connector to a counterpart, a grounding layer comprised in that counterpart and further wherein the housing comprises a protruding projection that contacts the grounding layer of the circuit substrate and that established electrical contact between the shielding and the grounding layer.

2. A cable connector according to claim 1, wherein said body of said connector module comprises a slit or opening for accommodating said protruding projection.

3. A cable connector according to claim 1, further wherein said housing contains two or more circuit substrates one above the other and each comprising a grounding layer and wherein said resilient clip abuts the grounding layers of at least two circuit substrates.

4. A cable connector according to claim 1, wherein said connector is attached to a cable comprising a shielding and wherein said shielding of said housing is electrically connected to the shielding of the cable.

5. A kit for assembling a connector according to claim 1, comprising a housing which forms a shielding or which is provided with a shielding, and at least one connector module placed or to be placed within the housing, which module comprises a body of an electrically insulating material, a circuit substrate comprising a grounding layer and one or more terminals mounted on the circuit substrate, wherein the housing comprises an inwardly protruding projection and/or the kit contains a resilient clip, wherein the projection and/or the clip, upon assembly of the connector, serve to establish electrical contact between the shielding and the grounding layer or layers.

6. A cable connector according to claim 1, wherein said projection is an inwardly protruding projection.

7. A cable connector according to claim 3, wherein said body of said connector module comprises a slit or opening for accommodating that part of said clip that electrically connects at least two of said grounding layers.

8. A cable connector according to claim 3, wherein said housing comprises a further resilient clip that electrically connects the outermost of said grounding layers that are connected by means of said first resilient clip to said shielding of said housing.

* * * * *